US007582852B2

(12) United States Patent
Cook et al.

(10) Patent No.: US 7,582,852 B2
(45) Date of Patent: Sep. 1, 2009

(54) MICROWAVE INTENSIFICATION SYSTEM FOR RAPID, UNIFORM PROCESSING OF FOOD ITEMS

(75) Inventors: Edward R. Cook, Cedar Rapids, IA (US); Rex E. Fritts, Cedar Rapids, IA (US); John Moses Osepchuk, Concord, MA (US)

(73) Assignee: ACP, Inc., Cedar Rapids, IA (US)

( * ) Notice: Subject to any disclaimer, the term of this patent is extended or adjusted under 35 U.S.C. 154(b) by 576 days.

(21) Appl. No.: 11/029,473

(22) Filed: Jan. 6, 2005

(65) Prior Publication Data

US 2005/0199618 A1 Sep. 15, 2005

Related U.S. Application Data

(60) Provisional application No. 60/552,196, filed on Mar. 12, 2004.

(51) Int. Cl.
*H05B 6/80* (2006.01)

(52) U.S. Cl. ..... 219/728; 219/725

(58) Field of Classification Search ..... 219/728, 219/727, 726, 725, 734, 745
See application file for complete search history.

(56) References Cited

U.S. PATENT DOCUMENTS

| | | | | |
|---|---|---|---|---|
| 3,662,141 | A | 5/1972 | Schauer, Jr. | |
| 3,701,872 | A | 10/1972 | Levinson | |
| 4,133,996 | A * | 1/1979 | Fread | 219/729 |
| 4,249,464 | A | 2/1981 | Hansen | |
| 4,280,032 | A * | 7/1981 | Levinson | 219/729 |
| 4,335,290 | A | 6/1982 | Teich | |
| 4,369,346 | A | 1/1983 | Hart et al. | |
| D268,163 | S | 3/1983 | Hansen | |
| 4,455,467 | A | 6/1984 | Dills | |
| 4,593,171 | A | 6/1986 | Colato | |
| 4,642,434 | A | 2/1987 | Cox et al. | |
| 4,831,224 | A * | 5/1989 | Keefer | 219/728 |
| 4,877,933 | A | 10/1989 | Yangas | |
| 4,990,735 | A | 2/1991 | Lorenson et al. | |
| 4,992,638 | A | 2/1991 | Hewitt et al. | |
| 5,057,659 | A | 10/1991 | Schneider et al. | |
| 5,142,114 | A | 8/1992 | Briggs et al. | |
| 5,223,685 | A | 6/1993 | DeRienzo, Jr. | |

(Continued)

FOREIGN PATENT DOCUMENTS

| | | |
|---|---|---|
| GB | 2171580 | 8/1986 |

(Continued)

*Primary Examiner*—Daniel L Robinson
(74) *Attorney, Agent, or Firm*—Diederiks & Whitelaw, PLC

(57) ABSTRACT

A microwave intensification system includes a base frame having a plurality of support members, a microwave transparent, central vessel, and at least one dielectric unit positioned within the central vessel. A cooking surface is formed by covering the dielectric unit with a protective covering. In operation, a food item is placed within a processing container and positioned on the cooking surface over the dielectric unit. The processing container is sized such that an overlap exists between the container and the dielectric unit in order to balance the exposure of the food item to a microwave energy field. With this arrangement, the food item can rapidly undergo a cooking process in a manner wherein central and edge portions of the food item are exposed to a uniform cooking process thereby increasing the quality of the final product.

12 Claims, 6 Drawing Sheets

U.S. PATENT DOCUMENTS

| | | | | | |
|---|---|---|---|---|---|
| 5,247,149 | A | * | 9/1993 | Peleg | 219/729 |
| 5,321,222 | A | * | 6/1994 | Bible et al. | 219/745 |
| 5,593,610 | A | * | 1/1997 | Minerich et al. | 219/728 |
| 5,726,428 | A | | 3/1998 | Christensen | |
| 5,864,123 | A | * | 1/1999 | Keefer | 219/728 |
| 5,910,268 | A | * | 6/1999 | Keefer | 219/728 |
| 5,986,249 | A | | 11/1999 | Yoshino et al. | |
| 6,034,363 | A | * | 3/2000 | Barmatz et al. | 219/750 |
| 6,172,348 | B1 | | 1/2001 | Yoshino et al. | |
| 6,255,637 | B1 | | 7/2001 | Collett | |
| 6,262,406 | B1 | | 7/2001 | McKee et al. | |
| 6,274,859 | B1 | | 8/2001 | Yoshino et al. | |
| 6,380,525 | B2 | * | 4/2002 | Dalton | 219/759 |
| 7,019,271 | B2 | * | 3/2006 | Wnek et al. | 219/730 |
| 2002/0003140 | A1 | | 1/2002 | Day et al. | |

FOREIGN PATENT DOCUMENTS

| | | |
|---|---|---|
| JP | 30145093 | 6/1991 |

* cited by examiner

MICROWAVE INTENSIFICATION SYSTEM FOR RAPID, UNIFORM PROCESSING OF FOOD ITEMS

CROSS-REFERENCE TO RELATED APPLICATION

The present application claims the benefit of U.S. Provisional Patent Application Ser. No. 60/552,196 entitled "Microwave Intensification System For Rapid, Uniform Processing of Food Items" filed Mar. 12, 2004.

BACKGROUND OF THE INVENTION

1. Field of the Invention

The present invention pertains to the art of cooking appliances and, more particularly, to a microwave energy intensification system for use in a microwave cooking appliance for rapidly and uniformly processing a food item.

2. Discussion of the Prior Art

In general, high-speed microwave processing or cooking of certain types of food items will result in poor food quality due to uneven cooking. Typically, central and outer sections of a food item may not be heated to the same temperature for the same time period. This is particularly true when cooking food items having different densities, such as a combination egg and meat filled product.

Safety concerns relating to contamination from pathogenic microorganisms require that certain food items be heated above 165° F. (74° C.) prior to human consumption. In particular, dairy and meat items must be pasteurized or cooked for a prescribed period above approximately 165° F. (74° C.) or else a consumer runs the risk of consuming a food item contaminated with a pathogenic bacteria. Unfortunately, when exposing a food item to the pasteurization process, the temperature distribution within a food item, in particular a combination food item, is not uniform. As is often the case, targeting 165° F. (74° C.) throughout a particular food item results in the outer edge portions of the food item achieving temperatures well beyond the targeted value. Consequently, the edges of the food item are generally over cooked and the central portion under cooked. Actually, if the edges of the food item are not allowed to "burn" for a sufficient time period, the central portions may not achieve the targeted temperature value. In this case, the consumer may still be exposed to harmful pathogenic microorganisms.

Various methods have been proposed in the prior art to more uniformly cook a food item. However, most of the methods proposed inherently involve various tradeoffs which negatively impact cooking efficiency, food costs and processing times. Proposed methods include processing the food for longer time periods at reduced power levels, reformulating the food items, and using a single mode microwave oven design, all of which necessarily increase cook times and/or add significant costs which, in the highly competitive field of microwave cooking, is not acceptable.

Based on the above, there exists a need in the art for a microwave intensification system which will provide for a uniform cooking environment for food items. More specifically, there exists a need for a microwave intensification system which will enable a food item to be uniformly cooked to a targeted temperature zone without detrimentally affecting the overall quality of the final food product.

SUMMARY OF THE INVENTION

The present invention is directed to a microwave intensification system for a cooking appliance including an oven cavity and a microwave generator. More specifically, the microwave intensification system constructed in accordance with the present invention includes a base frame portion having a plurality of support members and a microwave transparent central vessel supported by the base frame above a bottom surface of the oven cavity.

In accordance with a preferred embodiment of the present invention, at least one dielectric unit is positioned within the central vessel. In one form of the invention, the dielectric unit is formed from Alumina Oxide. In another form, the dielectric unit is formed from Zirconia. The unit preferably has a dielectric constant in the range of 6-12 and a dielectric loss tangent of between 0.0001 and 0.01. However, it should be understood that the dielectric constant could be as high as 20. Most preferably, the dielectric unit will have a dielectric constant of intermediate value between that of the particular food item and free space or air. The dielectric unit could take the form of a disk, a powder or a slurry so long as the qualities of the dielectric unit, i.e., the dielectric material, functions to shorten the wavelength of the microwave energy field at an interface between the unit and the food item. The shorter wavelength increases the number of energy nodes and produces a higher energy field concentration which, in turn, establishes a higher power concentration at the food item. The higher power concentration results in a more even cooking of the food item. Another function of the unit is to help match the incoming energy into the food material, which has a high value of dielectric constant. In theory, the unit should have a dielectric constant which is roughly equal to the square root of the dielectric constant of the food. In any event, when placed in specific proximity to certain food items, the dielectric properties of the dielectric unit balance central portion cooking with outer or edge portion cooking. In part, the dielectric unit helps reduce the field at any sharp corners of the food. With this arrangement, the microwave intensification system establishes a uniform cooking environment which results in a uniformly cooked food item.

In accordance with one aspect of the present invention, there could be provided a relatively thin dielectric cover layer or sheet between the dielectric unit(s) and the food. One function of this cover sheet is to act as a protective coating. Preferably, the protective coating is formed from a silicone rubber and defines a cooking surface onto which the food item is placed. Actually, the material of the cover sheet can be any microwave transparent material, preferably an FDA food grade material, that will protect the dielectric material from spills and various food debris that may accumulate on the surface during a cooking process. In a more preferred form of the invention, the food items are stored within a food processing container which is sized so that the food overlaps the dielectric unit onto which it is placed. More specifically, the food overlaps the dielectric unit, preferably about ½-¾ inches (1.27-1.91 cm), such that the food item is exposed to a more balanced microwave energy field.

In a more preferred embodiment, at least first and second dielectric units are positioned within the central vessel and covered with a microwave transparent protective covering to form first and second heating zones. In still another form of the invention, a plurality of central vessels are supported within the base frame. With this arrangement, multiple food items, each designed to undergo a similar cooking process, can be handled simultaneously. Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
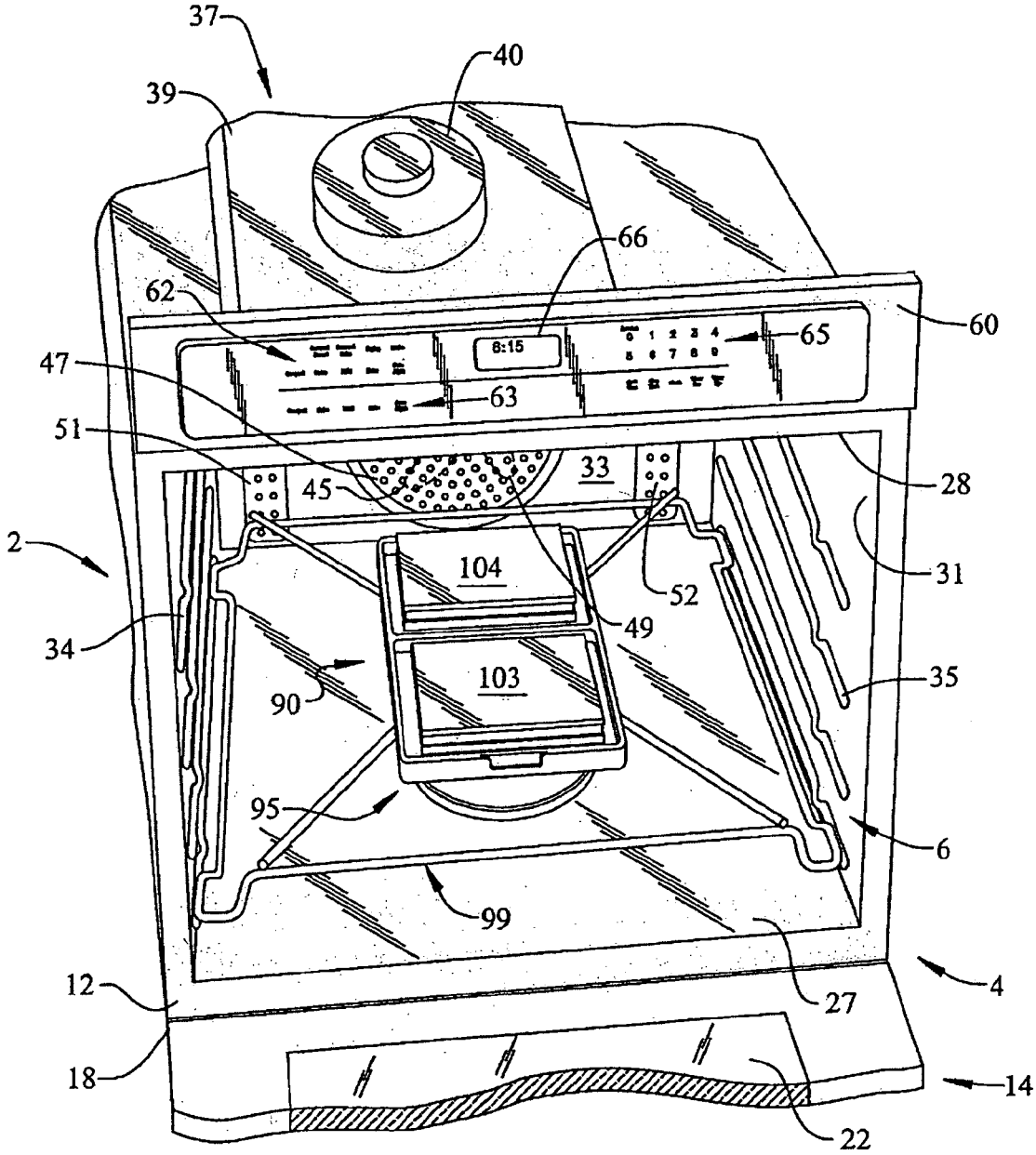
FIG. 1 is an upper perspective view of a microwave intensification system constructed in accordance with the present invention positioned within a microwave oven cavity.

With initial reference to FIG. 1, a cooking appliance constructed in accordance with the present invention is generally indicated at 2. Although the actual cooking appliance to which the present invention may be incorporated may vary, the invention is shown in connection with cooking appliance 2 depicted as a single wall oven. However, it should be understood that the present invention is not limited to this particular model type and can be incorporated into various types of microwave oven configurations, e.g., cabinet mounted ovens, dual wall oven units, and free standing units. In the embodiment shown, cooking appliance 2 includes an oven 4 having associated therewith an oven cavity 6. In a manner known in the art, oven 4 is provided to perform a combination microwave/convection cooking process. However, it should be recognized that the present invention can be employed in any type of cooking appliance employing microwaves as an energy source. As shown, cooking appliance 2 includes an outer frame 12 which supports oven cavity 6 within associated structure, such as a wall, kitchen cabinetry or the like.

In a manner known in the art, a door assembly 14, which is adapted to pivot at a lower portion 18, is mounted to frame 12 to selectively provide access to oven cavity 6. In a manner also known in the art, door 14 is provided with a transparent zone 22 for viewing the contents of oven cavity 6 while door 14 is closed. In addition, a seal and microwave choke (not shown) are provided about a peripheral edge portion of door assembly 14 to prevent both oven gases and microwaves from escaping from within oven cavity 6.

As best seen in FIG. 1, oven cavity 6 is defined by a smooth bottom portion 27, an upper portion 28, opposing side portions 30 and 31 and a rear portion 33. Preferably, arranged on each opposing side portion 30 and 31 are a plurality of vertically spaced and fore-to-aft extending rack support guides indicated generally at 34 and 35. Arranged above oven cavity 6 is a microwave applicator or power source generally indicated at 37. Microwave applicator 37 includes a waveguide 39 having arranged thereon a microwave emitter or magnetron 40. As further shown in FIG. 1, cooking appliance 2 includes a convection heating system indicated generally at 45. Preferably, convection heating system 45 includes an inlet vent cover 47 arranged on rear portion 33 of oven cavity 6, a fan assembly 49, and first and second outlet vents 51 and 52 arranged on opposing sides of vent cover 47. Finally, cooking appliance 2 includes an upper control panel 60 arranged above oven cavity 6 and carried at least partially by frame 12. In the embodiment shown, control panel 60 includes first and second rows of oven control buttons 62 and 63 for programming, in combination with a numeric pad 65 and a display 66, particular cooking operations for oven 4. Since the general programming and operation of cooking appliance 2 is known in the art and does not form part of the present invention, these features will not be discussed further here.

In general, the structure described above with respect to cooking appliance 2 is already known in the art and does not constitute part of the present invention. Therefore, this structure has only been described for the sake of completeness. Instead, the present invention is particularly directed to a microwave intensification system 90 and, more particularly, to a microwave intensification system 90 including a base unit or central vessel 95 supported within oven cavity 6 by a support frame 99. Microwave intensification system 90 is adapted to establish a uniform cooking environment for a food item undergoing a microwave cooking process, particularly a food item positioned within a food processing container, such as those indicated at 103 and 104.

Figure 2:
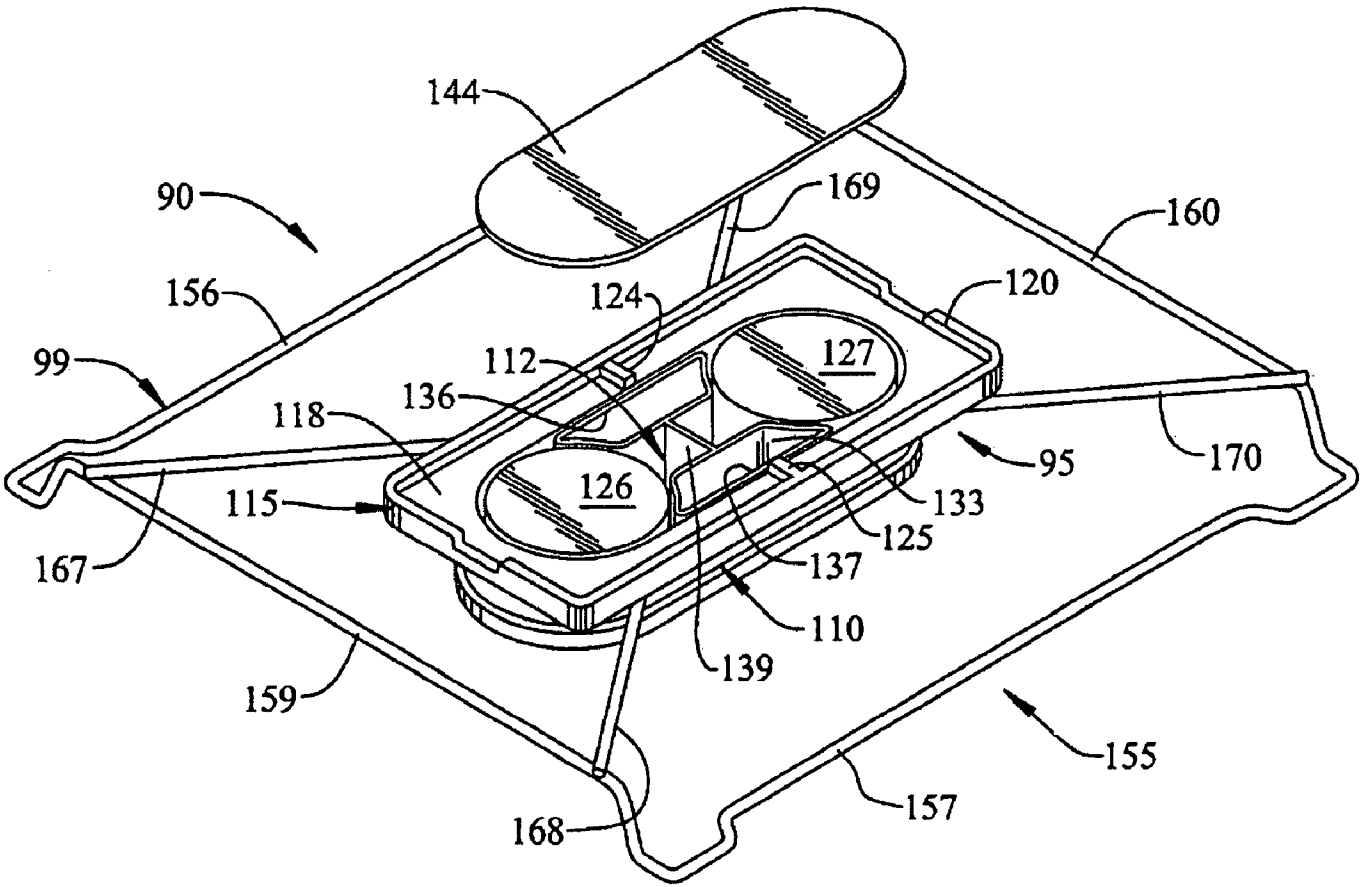
FIG. 2 is a partially exploded, perspective view of the microwave intensification system of FIG. 1.

With particular reference to FIG. 2, base unit 95 includes a lower section 110 having a hollow interior portion 112 extending to an upper section 115. In accordance with this preferred form of the invention, base unit 95 is formed from a microwave transparent material, such as PTFE, polypropylene or polyethylene. As shown, upper section 115 includes a supporting surface 118 which, in the embodiment shown, extends about hollow interior portion 112. Projecting from a peripheral edge of supporting surface 118 is an upstanding ledge portion 120. In the embodiment shown, upstanding ledge portion 120 includes first and second container spacers 124 and 125 that project from upstanding ledge 120 toward hollow interior portion 112 along supporting surface 118. As will be discussed more fully below, spacers 124 and 125 function to position food items in a particular relationship upon supporting surface 118.

In accordance with a preferred form of the invention, arranged within hollow interior portion 112 are first and second dielectric units 126 and 127. Preferably, dielectric units 126 and 127 are formed from Alumina oxide ($AL_2O_3$) or Zirconia having a dielectric constant in the range of 6-12 and a loss tangent preferably as low as possible. However, it should be understood that the dielectric constant could be as high as 20. More preferably, dielectric disks 126 and 127 are formed from a material having a dielectric constant less than that of the food product to be heated and a dielectric loss tangent below 0.01. In further accordance with the invention, dielectric units 126 and 127 could take the form of disks, a powder or even a slurry so long as a close relationship is established between the dielectric constant of units 126 and 127 and the food item. With this arrangement, the particular qualities of the dielectric material function to shorten the wavelength of the microwave energy field creating localized field concentrations which, in turn, result in a more uniform heat distribution within the food item.

As shown, first and second dielectric units 126 and 127 are maintained in a spaced relationship by a spacer assembly 133. More specifically, spacer assembly 133 includes first and second spacer elements 136 and 137 separated by an intermediate web portion 139. With this arrangement, food containers, such as indicated at 103 and 104 in FIG. 1, are located by spacers 124 and 125 over dielectric units 126 and 127 respectively. Preferably, each food container 103 and 104 is positioned such that ½to ¾ inches (1.27-1.91 cm) of the container 103, 104 overlaps a respective one of disks 126 and 127. Finally, a protective cover or grease shield 144 is positioned over disks 26 and 127 to prevent grease and other food byproducts from entering interior portion 112 or accumulating on first and second dielectric disks 126 and 127. Preferably, cover 144 is formed from a molded silicone rubber or similar microwave transparent material and is arranged upon an inner ledge (not labeled) of supporting surface 118 such that it can be easily removed for cleaning.

Figure 3:
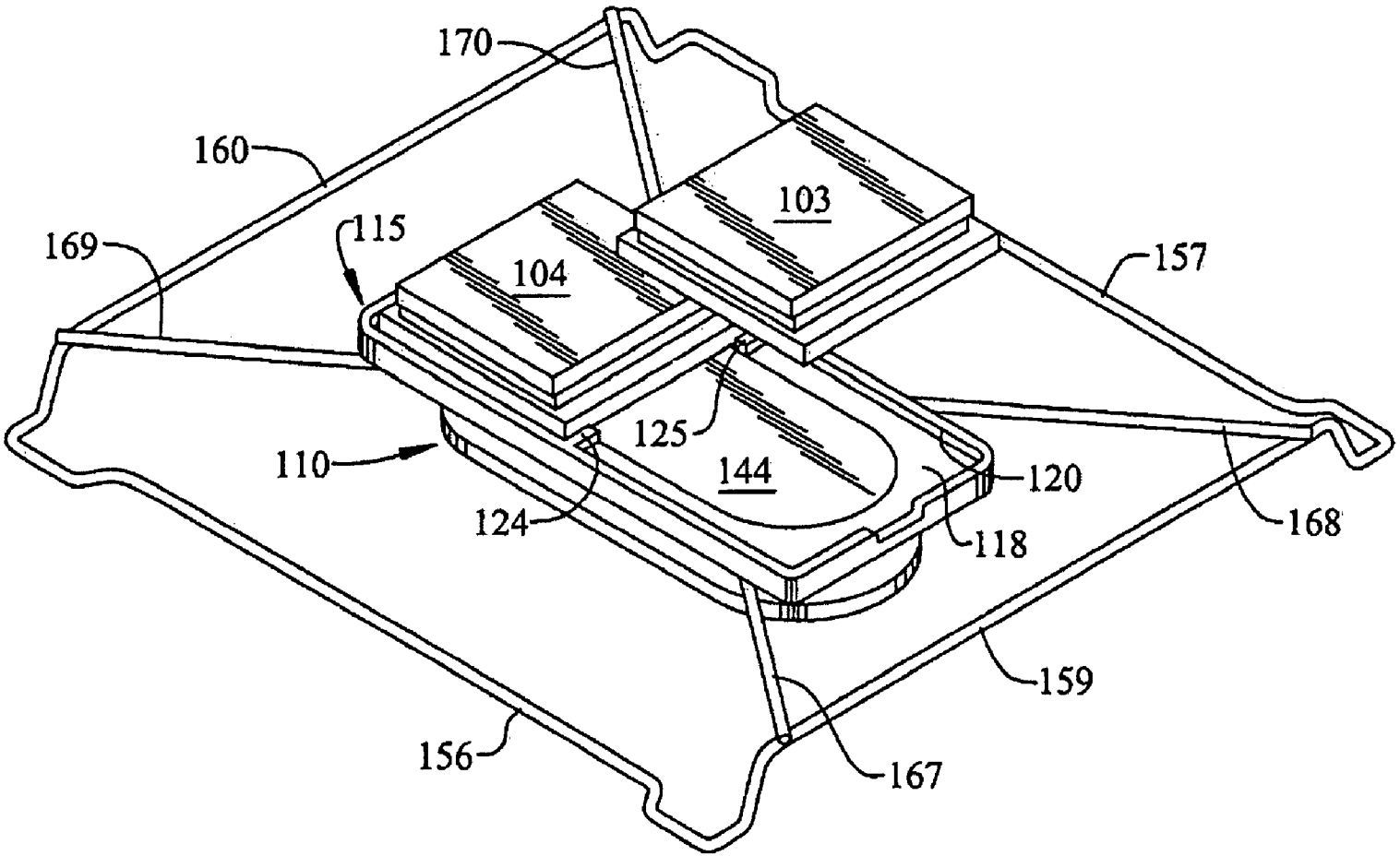
FIG. 3 is a perspective view illustrating a pair of food processing containers positioned on a support surface of the microwave intensification system of FIG. 1.

As best seen in FIGS. 2 and 3, support frame 99 of intensification system 90 includes a base section 155 defined by opposing side support members 156 and 157 interconnected through a front support member 159 and a rear support member 160. As shown, support frame 99 further includes a plurality of vessel support members 167-170 which are respectively secured to front support member 159 and rear support member 160 and project inward toward a center of base section 155. More specifically, vessel support members 167-170 interconnect with a vessel support ring (not shown) which is adapted to snap-fittingly receive central vessel 95. In a preferred form of the invention, side support members 156 and 157, front support member 159, rear support member 160 and vessel support members 167-170 are formed from metallic wire. However, it should be understood that various other materials usable in a microwave and high heat environment could also be employed.

Figure 4:
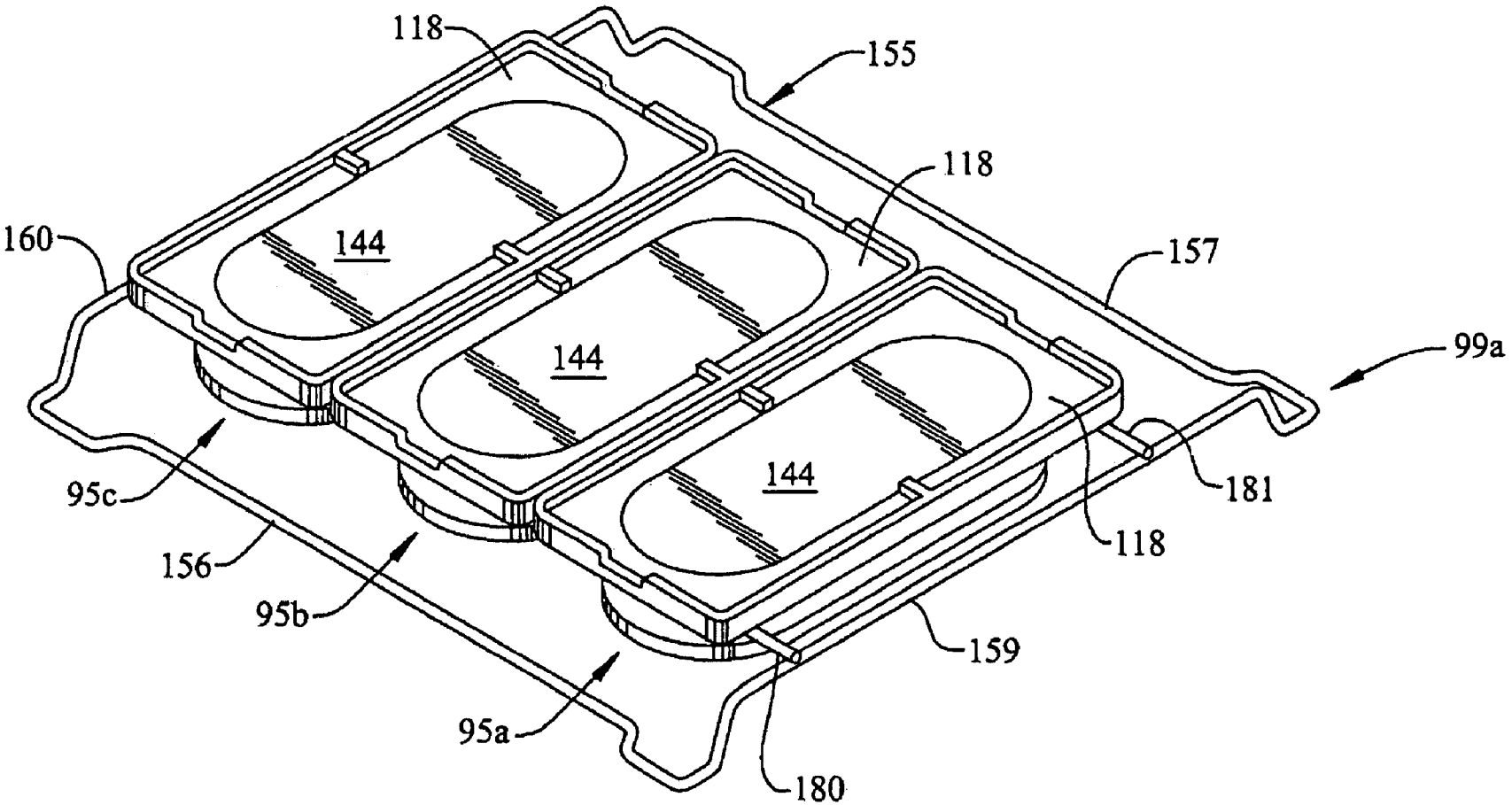
FIG. 4 is a perspective view of a microwave intensification system constructed in accordance with a second embodiment of the present invention.

At this point, it should be understood that the number and size of base units 95 capable of being supported within support frame 99 can vary in accordance with the invention while still enabling support frame 99 to facilitate the loading and unloading of food items into cooking appliance 2. To this end, FIG. 4 shows a support frame 99*a* constructed in accordance with a second embodiment of the present invention. As shown, support frame 99*a* includes a base section 155 constructed in a corresponding similar to that shown in FIGS. 1-3. However, vessel support members 167-170 are replaced by a pair of vessel support members 180 and 181 which are arranged parallel to one another and extend from front support member 159 to rear support member 160. With this arrangement, a plurality of vessels, such as those indicated at 95*a*, 95*b* and 95*c*, are capable of being simultaneously supported by support frame 99*a* thereby increasing the number of food items capable of being processed at a given time period.

Figure 5:
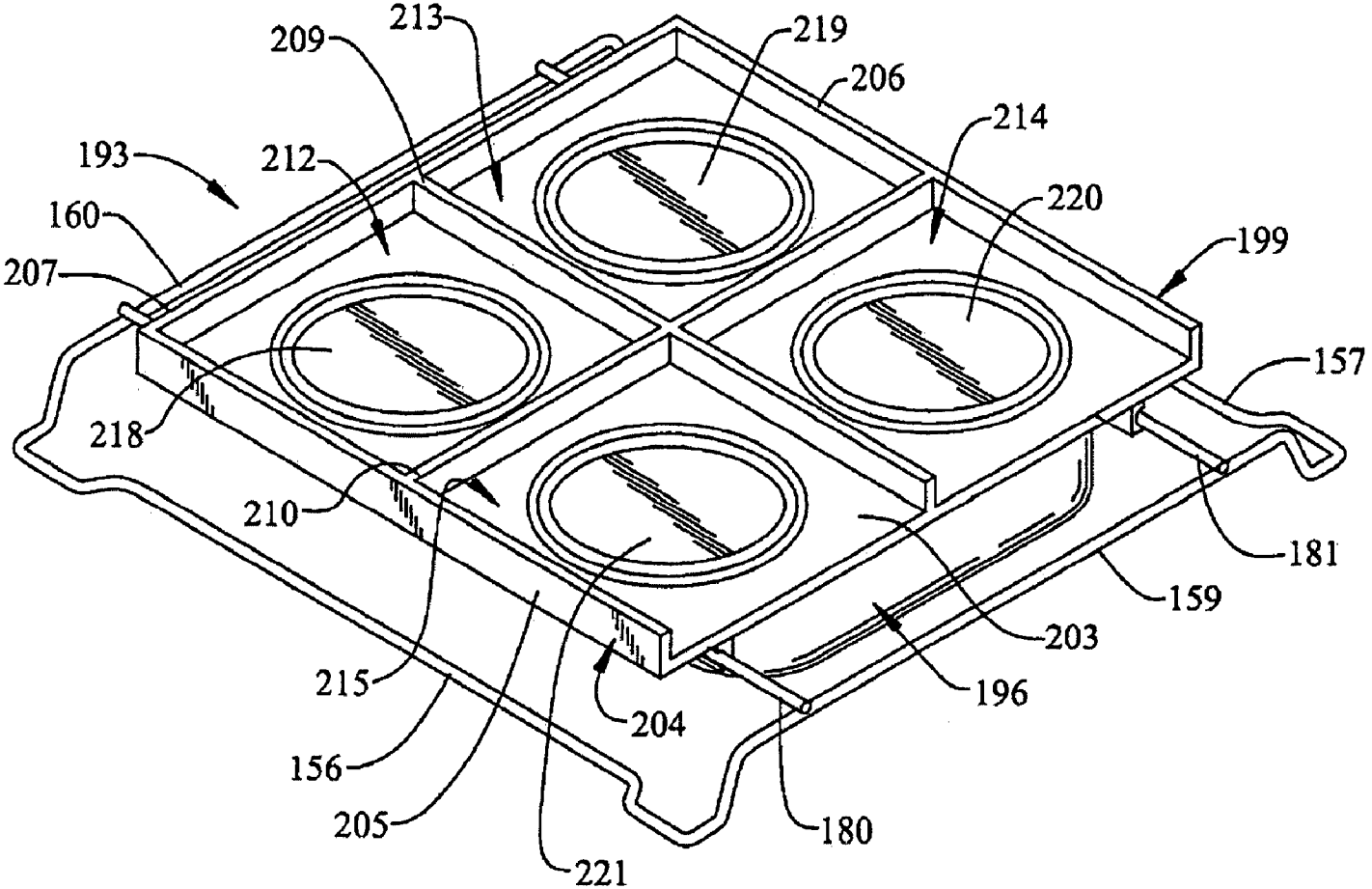
FIG. 5 is a perspective view of a microwave intensification system constructed in accordance with a third embodiment of the present invention.

Referring to FIG. 5, a central vessel 193 is shown constructed in accordance with a third embodiment of the present invention. As illustrated, central vessel 193 includes a lower section 196 interconnected to an upper section 199. Upper section 199 includes a support surface 203 having an upstanding peripheral wall portion 204 including opposing side sections 205 and 206 interconnected by a rear section 207. Support surface 203 is divided into four quadrants by a first wall portion 209 extending from approximately a midpoint of rear wall 207 to a front edge of support surface 203, and a second wall portion 210 interconnecting approximate midpoints of opposing side walls 205 and 206. With this arrangement, four cooking zones 212-215 are established upon support surface 203. In a manner similar to that described with reference to central vessel 95, each respective cooking zone 212-215 includes an associated central portion 218-221 below which is arranged a corresponding dielectric unit (not shown). With this arrangement, a plurality of food containers can be supported by central vessel 193 for simultaneous processing in microwave oven 4.

Figure 6:
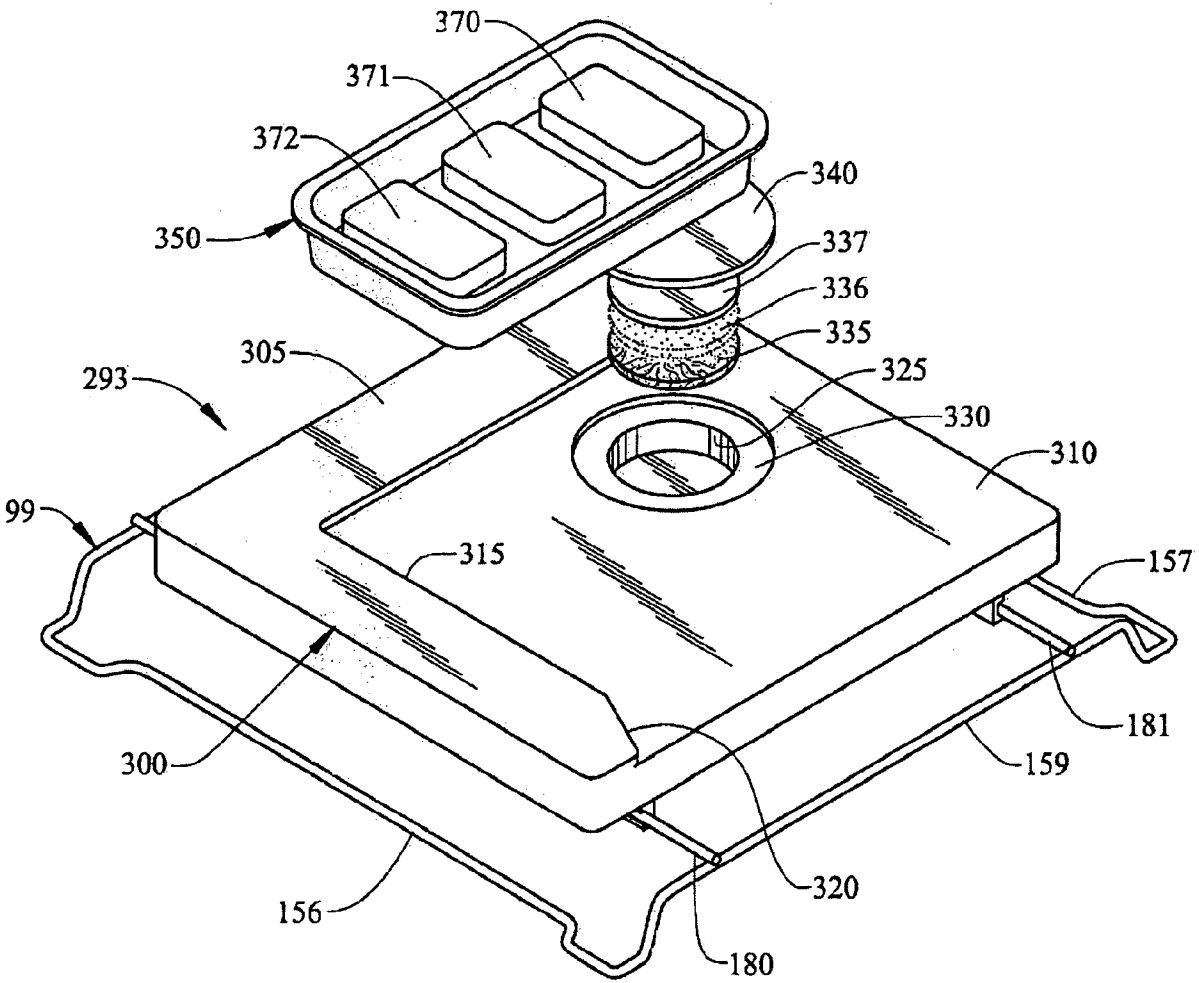
FIG. 6 is a partial exploded view of a microwave intensification system constructed in accordance with a fourth embodiment of the invention.

FIG. 6 shows another preferred embodiment of the invention illustrating a central vessel 293 utilized in combination with support frame 99. In accordance with this embodiment, central vessel 293 includes a base 300 which is preferably formed from a microwavable plastic material. As shown, support base 300 includes an upper surface portion 305 and a lower surface portion 310. Surface portions 305 and 310 are vertically spaced such that an upstanding wall 315 is defined. In the most preferred embodiment, upstanding wall 315 includes an angled, lead-in section 320. Lower surface portion 310 is formed with a first countersunk portion 325 and a second, countersunk portion 330. Countersunk portion 330 extends about countersunk portion 325 so as to essentially define a ledge about countersunk portion 325 as clearly shown in this figure.

This embodiment of the microwave energy intensification system of the invention further includes one or more dielectric units 335-337 which are either sized so as to be recessed within countersunk portion 325 or otherwise used to fill countersunk portion 325. Arranged atop dielectric units 335-337 is a spacer or protective cover 340. Protective cover 340 is sized so as to seat upon the ledge defined by countersunk portion 330, with an upper surface (not separately labeled) of protective cover 340 being substantially flush with lower surface portion 310. Protective cover 340 is thereafter secured within countersunk portion 330 through, for example, a sonic welding process. In accordance with the invention, protective cover 340 need not be employed. In addition, dielectric units 335-337 could project slightly above lower surface 310, for example, $^{40}/_{1000}$ inch (1.02 mm) such that the food item is only separated from dielectric units 335-337 by a bottom surface of a tray or other form of packaging material as will be detailed more fully below. Alternatively, dielectric units 335-337 could be inserted from an underside portion of central vessel 293 and made substantially flush with lower surface portion 310, preferably while being encapsulated within support base 300.

Furthermore, this embodiment is shown to employ a food tray 350 within which is arranged food items 370-372. Food tray 350 is formed from a microwave safe material and, although not shown, can be compartmentalized. In the preferred embodiment shown, food tray 350 is sized so as to be positioned upon lower surface 310 against portions of upstanding wall 315, with at least a portion of food tray 350 being arranged over protective cover 340 and dielectric units 335-337. This arrangement has been found to be particularly advantageous when food items 370-372 are from different food groups and therefore it is desired to subject these food groups to different levels of microwave cooking. For example, with food item 370 constituting a meat, food item 371 constituting a starch and food item 372 constituting a vegetable, the microwave intensification developed through the use of the dielectric units 335-337 can be easily concentrated on one of more of the food groups, such as food item 370, by properly positioning food tray 350 against upstanding wall 315, with angled portion 328 functioning to guide food tray 350 to the proper corner position on lower support surface 310.

Although described with reference to preferred embodiments of the invention, it should be readily understood that various changes and/or modifications can be made to the invention without departing from the spirit thereof. For instance, while the microwave intensification system of the invention is shown mounted in a convection/microwave oven, it should be readily understood that the present invention is equally adaptable to standard microwave oven applications. In addition, while the food items are shown being processed within covered food processing containers, other types of containers, including those without covers, are equally acceptable. Also, while the dielectric units are described as being provided with a protective cover, it should be realized that the protective cover itself is optional. In general, the invention is only intended to be limited by the scope of the following claims.

We claim:

1. A microwave cooking appliance comprising:

an oven cavity including top, bottom, rear and opposing side portions;

a microwave applicator for introducing a microwave energy field into the oven cavity to perform at least a portion of a cooking process; and a microwave energy intensification system including a central vessel which is supported above the bottom portion of the oven cavity and transparent to microwave energy, at least one dielectric unit positioned within the central vessel, and a protective cover extending over the at least one dielectric unit, said protective cover partially defining a cooking surface onto which a food item to be cooked is placed, wherein the dielectric unit is sized such that food to be cooked overlaps the dielectric unit by a predetermined distance in the range of ½ to ¾ inches (1.27-1.91 cm).

2. The microwave cooking appliance according to claim 1, wherein the at least one dielectric unit includes first and second dielectric units surrounded in the central vessel, each of said first and second dielectric units at least partially defining a respective one of first and second heating zones.

3. The microwave cooking appliance according to claim 1, wherein the at least one dielectric unit is constituted by a plurality of disks.

4. The microwave cooking appliance according to claim 1, wherein the central vessel includes four cooking zones, each of said four cooking zones being separated by a plurality of intermediate wall portions.

5. The microwave cooking appliance according to claim 1, wherein the at least one dielectric unit is formed from Alumina Oxide ($Al_2O_3$).

6. The microwave cooking appliance according to claim 1, wherein the at least one dielectric unit is formed from Zirconia.

7. The microwave cooking appliance according to claim 1, further comprising at least one food processing container containing the food, said food processing container being supported upon the cooking surface.

8. The microwave cooking appliance according to claim 1, wherein the protective cover is formed from silicone rubber.

9. A microwave cooking appliance comprising;

an oven cavity including top, bottom, rear and opposing side portions;

a microwave applicator for introducing a microwave energy field into the oven cavity to perform at least a portion of a cooking process;

a microwave energy intensification system including a central vessel which is supported above the bottom portion of the oven cavity and transparent to microwave energy, at least one dielectric unit positioned within the central vessel, and a protective cover extending over the at least one dielectric unit, said protective cover partially defining a cooking surface onto which a food item to be cooked is placed; and a base frame having a plurality of support members, said base frame supporting the central vessel above the bottom portion of the oven cavity.

10. The microwave cooking appliance according to claim 9, wherein the central vessel is snap-fittingly received by the base frame.

11. The microwave cooking appliance according to claim 9, wherein the opposing side portions of the oven cavity include a plurality of opposing rack support rails, the base frame of said microwave energy intensification system being removably supported upon a respective pair of said plurality of opposing rack support rails.

12. The microwave cooking appliance according to claim 9, wherein the base frame is adapted to support a plurality of central vessels.

* * * * *